United States Patent [19]

Enck, Jr. et al.

[11] Patent Number: 4,940,919

[45] Date of Patent: Jul. 10, 1990

[54] SUPPORT STRUCTURE FOR VACUUM TUBE COMPONENTS

[75] Inventors: Richard S. Enck, Jr.; Gregg A. Hindenes, both of San Jose; Ian K. Glasgow, Palo Alto, all of Calif.

[73] Assignee: Picker International, Inc., Cleveland, Ohio

[21] Appl. No.: 303,722

[22] Filed: Jan. 23, 1989

[51] Int. Cl.[5] ..... H01J 1/88; H01J 19/42; H01J 43/00

[52] U.S. Cl. ..... 313/526; 313/482; 313/238; 313/288

[58] Field of Search ..... 313/390, 383, 525, 526, 313/482, 238, 288

[56] References Cited

U.S. PATENT DOCUMENTS

| | | | |
|---|---|---|---|
| 3,256,455 | 6/1966 | Saldi | 313/89 |
| 3,331,979 | 7/1967 | Sybeldon et al. | 313/64 |
| 3,549,229 | 12/1970 | Moegenbier | 316/21 |
| 3,609,435 | 9/1971 | Taylor | 313/93 |
| 3,876,897 | 4/1975 | Geyer | 313/390 |
| 3,887,827 | 6/1975 | Katayama | 313/390 |
| 3,919,582 | 11/1975 | Ochs | 313/383 |
| 4,103,203 | 7/1978 | Ochs | 313/390 |
| 4,140,900 | 2/1979 | Wang | 250/213 VT |
| 4,255,666 | 3/1981 | Wang et al. | 250/486 |
| 4,315,183 | 2/1982 | Merritt | 313/94 |
| 4,730,107 | 3/1988 | Enck, Jr. et al. | 250/213 VT |

*Primary Examiner*—Kenneth Wieder
*Attorney, Agent, or Firm*—Timothy B. Gurin

[57] ABSTRACT

A proximity type image intensifier having an evacuated electrically conductive tube envelope is described. The image intensifier tube includes improved structure for supporting components within the tube envelope. The support structure includes a support ring having a first inwardly extending edge portion which defines a support surface for supporting the component, and a second inwardly extending edge portion which defines a compression surface and component access aperture. The retaining ring includes a planar inner surface and an outer edge surface. The inner surface contacts the component supported in the support ring. The retaining ring is allowed to expand whereupon the outer edge surface engages the support ring compression surface. Radial expansion of the retaining ring creates an axial compression force between the retaining ring inner surface and the support surface about the circumference of the component being supported. The supported component is mounted within the tube envelope through a plurality of electrically insulated rods arranged in the plane of the component, each of the rods connected at one end to the envelope and at the other end to the circumference of the support ring. The rods include spring loaded pins which pass through corresponding recesses located at a plurality of circumferential spaced locations on the support ring. Additional embodiments are described.

24 Claims, 2 Drawing Sheets

SUPPORT STRUCTURE FOR VACUUM TUBE COMPONENTS

TECHNICAL FIELD

The present invention relates generally to the field of vacuum tubes and more particularly to an improved structure for supporting a component within an x-ray image intensifier tube.

BACKGROUND ART

A large sized proximity type image intensifier tube has been developed and is the subject of U.S. Pat. Nos. 4,140,900; 4,255,666 and 4,730,107. In this type of proximity image intensifier tube, at least one stage of amplification is provided between an inwardly concave metallic input window and a phosphor output screen deposited on a glass output viewing window. Each amplification stage includes a photocathode carrying substrate supported in a ring and suspended within a metallic tube envelope on insulating rods attached to the ring. A high voltage is applied to the substrate assembly through one of the insulated support rods to create a high voltage potential between the substrate assembly and the metallic tube envelope. Such a suspension system is more fully described in U.S. Pat. No. 4,315,183 to Merritt and which is incorporated herein by reference.

The substrate assembly is supported against a shoulder of the support ring and is mounted by way of many parts, most of which require special coating to prevent gauling. Threaded aluminum studs in the support ring shoulder area are pressed into the support ring around its circumference. Spring holders and pin holders are fixed to the support ring by way of the threaded studs by nuts torqued to specific values. The substrate assembly is radially aligned within the support ring by a plurality of wavy springs. Each spring is attached to a spring holder and applies radial force to the outer perimetral edge of the substrate assembly. At each contact point between a spring portion and the edge of the substrate assembly, a high voltage contact is placed.

The high voltage contacts include a plurality of metal U-shaped channel portions each of which extend over a small portion of the circumference of the substrate assembly and fit between the spring contact and the perimetral edge of the substrate assembly. To complete the assembly, a circular cover plate fits on the opposite side of the substrate assembly to capture it against the shoulder of the support ring. A plurality of screws attach the cover plate to the support ring.

Many disadvantages attain from this substrate support assembly. Well over 50 separate parts, many of which need to be specially coated are required to complete the assembly. Since threaded parts are used, many sharp edges are presented and are the possible source for undesirable high voltage emission and extraneous particles. Vibration and shock testing at possible and probable levels of transport and handling have shown that the electrodes tend to move around in the support. This undesired movement may create or dislodge extraneous particles within the tube envelope. Since shocks and vibrations are amplified, the tube is more sensitive to mechanical disturbances.

It is therefore an object of this invention to overcome the above mentioned problems and others by providing an improved component support for use in vacuum tubes and in particular a substrate support for use in proximity type image intensifier tubes.

DISCLOSURE OF THE INVENTION

The disadvantages of the prior art as described above are reduced or eliminated by the provision of an improved vacuum tube component support assembly.

In the preferred embodiment of the present invention, a circular support ring having a "C" shaped cross section is provided. The bottom leg of the "C" forms a first inwardly extending edge portion around the inner periphery of the support ring which defines a component support surface forming a circle and having an inside diameter less than the diameter of the component it is to support. The upper leg of the "C" forms a second inwardly extending edge portion around the inner periphery of the support ring which is axially displaced from the first edge portion. The second edge portion forms a compression surface and a component access aperture having an inside diameter greater than the component diameter.

A retaining ring is also provided to firmly secure the component in the support ring. The retaining ring is a flat split spring ring which is contractable to a diameter less than the support ring access aperture and expandable to a diameter greater than the support ring access aperture. One side of the retaining ring forms a planar inner surface which, in operation, comes into contact with the perimetral edge of the component on a side opposite the component support surface. The other side of the retaining ring forms an outer edge surface which engages the support ring compression surface. As the retaining ring radially expands, the interaction between the support ring compression surface and the retaining ring outer edge surface creates an axial compression force to compress the component between the support surface and the retaining ring inner surface. In this manner, a substantially equal compression force is created about the circumference of the component.

The component support assembly is suspended from the tube envelope by way of a plurality of insulated support rods which are arranged in the plane of the planar component. Each of the rods is perpendicularly attached at one end to the edge of the component and at its distal end to the tube envelope. Each of the support rods has a spring loaded pin protruding from the end which attaches to the component. At a plurality of circumferentially spaced locations on the support ring, radially aligned holes receive a corresponding pin. The pins extend through the support ring and contact the perimetral edge of the component for radial positioning of the component in the support ring. Alternately, each support rod has a rigidly mounted pin protruding from the end which attaches to the component. In this embodiment, the component is prealigned in the support ring.

By mounting the component in this fashion, dozens of parts are eliminated. Performance is improved because the few parts used have very few edges, all of which are radiused, and the component is supported more firmly over a greater area. Extraneous particles are less likely to be present or created.

In another aspect of the present invention, the retaining ring includes a wing portion which extends perpendicular to the retaining ring inner surface along its outer perimeter and in a direction opposite the retaining ring outer edge surface. The wing portion is used to aid in the insertion and removal of the component from the support ring. As the retaining ring is contracted, the wing portion grabs the perimeter of the component so that it can be manipulated and inserted/removed through the access aperture.

In yet another aspect of the present invention, a sheet metal band extending around the perimeter of the component, is provided. The band includes a pair of radially extending flange portions which are axially displaced from one another. The band accommodates the peripheral edge of the component and is sandwiched between the component and the component support surface, and the component and the retaining ring inner surface. The band spreads electrical charge and serves as an electrical connector for the component. It also protects the component from damage during handling, as well as during shock and vibration.

The foregoing and other objectives, features and advantages of the present invention will become apparent to those of ordinary skill in the art upon reading and understanding the following detailed description of the preferred embodiment.

BRIEF DESCRIPTION OF THE DRAWINGS

The invention may be embodied in various steps and arrangements of steps and various components and arrangements of components. The drawings are only for purposes of illustrating a preferred embodiment and are not to be construed as limiting the invention.

BEST MODE FOR CARRYING OUT THE INVENTION

Figure 1:
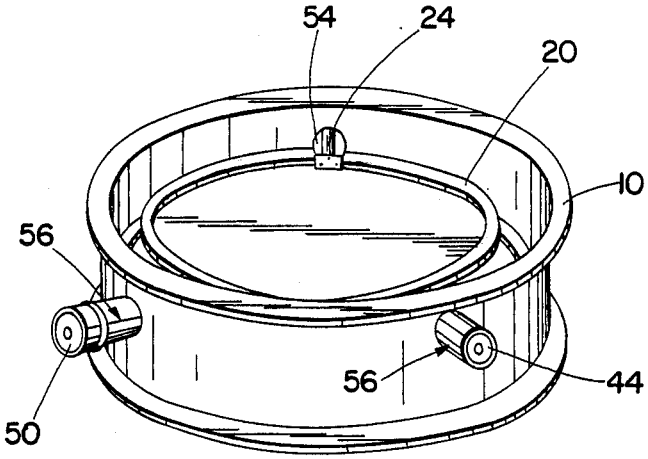
FIG. 1 is a perspective view of a portion of a single stage image intensifier tube and envelope, and high voltage support structure.
Figure 2:
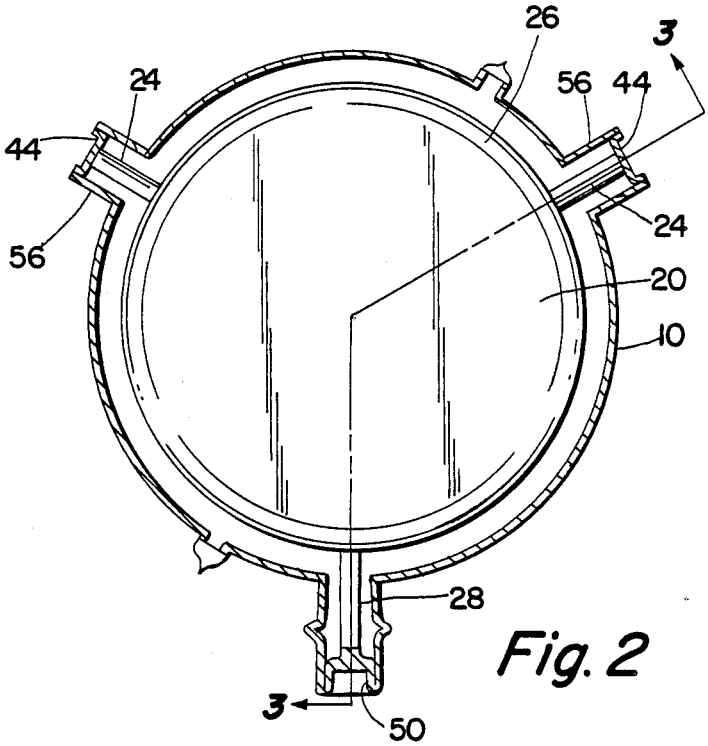
FIG. 2 is a horizontal, sectional view of the image intensifier tube depicted in FIG. 1 taken perpendicularly to the longitudinal axis of the tube envelope.
Figure 3:
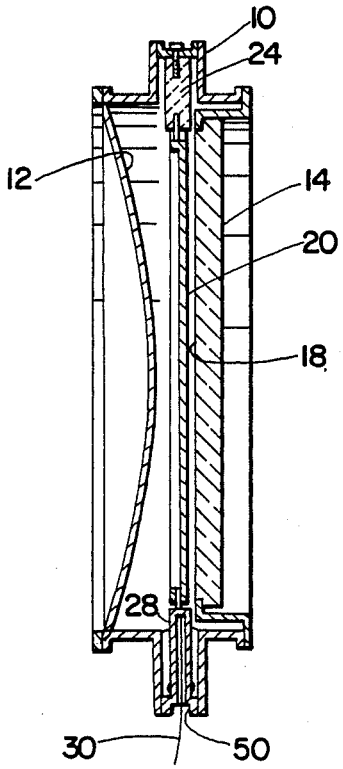
FIG. 3 is a vertical, sectional view taken generally along lines 3—3, in FIG. 2.

Referring now more particularly to FIGS. 1 and 2, a metallic envelope 10 of a proximity type image intensifier tube is illustrated. This type of tube is described in detail in U.S. Pat. Nos. 4,140,900; 4,255,666 and 4,730,107 owned by the present assignee and incorporated herein by reference. As best illustrated in FIG. 3, the envelope is closed at one end by an inwardly concave metallic input window 12 and is closed at the other end by a glass window 14 upon which an output phosphor display screen is deposited. In between the windows 12 and 14, one or more high voltage components are suspended. In the single stage tube illustrated in FIG. 3, high voltage component 20 is a scintillator-photocathode substrate assembly. The operation of the tube is described in detail in the above incorporated patents and therefore will not be described in further detail herein except to note that a high voltage is applied between the planar component 20 and the output display screen 18 on window 14.

It is to be noted that the use of the term "component" means any of the high voltage substrate assemblies described in the above referenced patents, any electrode or other component which is mountable within an envelope of a vacuum tube utilizing the structure of the present invention.

Because the tube envelope 10 is metallic, it is necessary that the high voltage components be suspended from the envelope by electrical insulators. This is accomplished by means of a plurality of radially projecting support rods 24, 28 which are made of electrically insulative material. The support rods are arranged in the plane of the planar component and are attached perpendicularly at one end to the edge of a support ring 26 and at their distal end to the tube envelope 10. One of the support rods 28 is hollow and encases a wire conductor 30 connected to a high voltage source (not shown).

Figure 4:
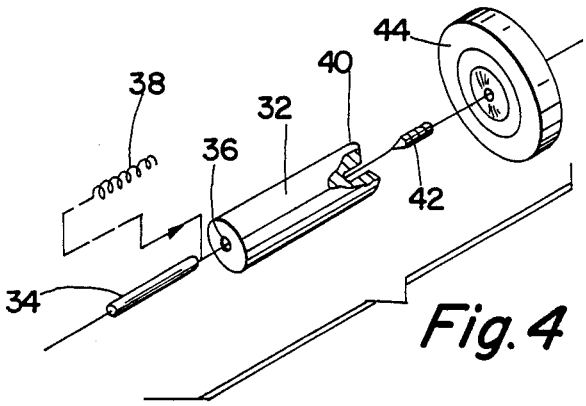
FIG. 4 is an exploded, perspective view showing the assembly of the insulating support rods according to the invention.
Figure 5:
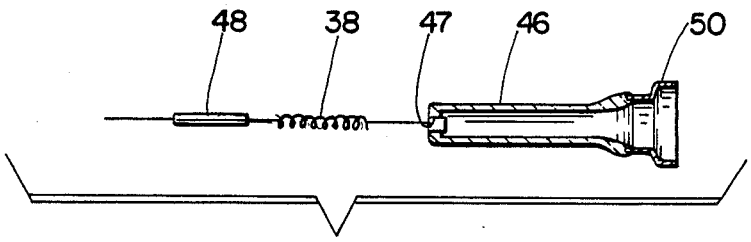
FIG. 5 is an exploded, perspective view showing the assembly of one of the conductor input support rods according to the invention.

Referring now more particularly to FIGS. 4 and 5, the construction of the support rods 24 and 28 will be described in greater detail. The support rod 24 is comprised of a rod of insulating ceramic material 32 which has a chrome oxide coating on it to bleed off accumulated electrostatic charges. The end of the rod 32 which attaches to the ring 26 is fitted with an anodized aluminum (or other suitable material) pin 34 which fits into a corresponding hole 36 in the rod 32. Between pin 34 and the bottom of hole 36, a compression spring 38 which forces the pin outward when compressed may be utilized. The action of the spring loaded pin in conjunction with the support ring and the component will be described in more detail below. Optionally, a longer pin 34 may be used in hole 36 without spring 38. The distal end of the rod 32 has a threaded hole 40 for receiving a threaded stud 42. The other end of the stud 42 screws into a stainless steel disk or cap 44.

The conductor carrying support rod 28 is comprised of a hollow glass tube 46. A hollow alloy (KOVAR type) sleeve 47 which matches the thermal expansion characteristics of the glass tube 46 fits in one end of the hollow tube. The opposite end of the tube 46 is mounted to an alloy adapter 50 by a glass to metal seal. The inner bore of sleeve 47 accepts a spring 38 and a pin 48. The action of the pin/spring combination is the same as described in conjunction with support rod 24.

Figure 6:
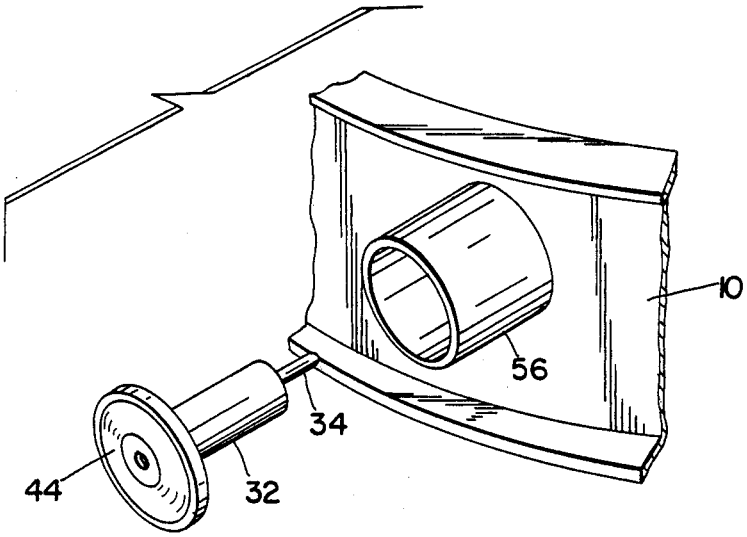
FIG. 6 is an enlarged, exploded perspective view of a portion of the image intensifier tube of FIG. 1 together with the of the insulating support rods.

Referring now more particularly to FIG. 6 it will be seen that the tube envelope 10 has a plurality of openings 54 in its exterior surface (FIG. 1) and that radially projecting tubes or sleeves 56 are joined to the exterior surface of the envelope 10 and about the edges of the openings 54. Each support rod 24 and 28 is inserted coaxially within a separate one of the tubes 56 until the end cap 44 or adaptor 50 seals off the exterior end of the opening in the tube 56. Caps 44 and adapter 50 are welded into place to seal the respective openings. This is best viewed in FIG. 2.

Figure 7:
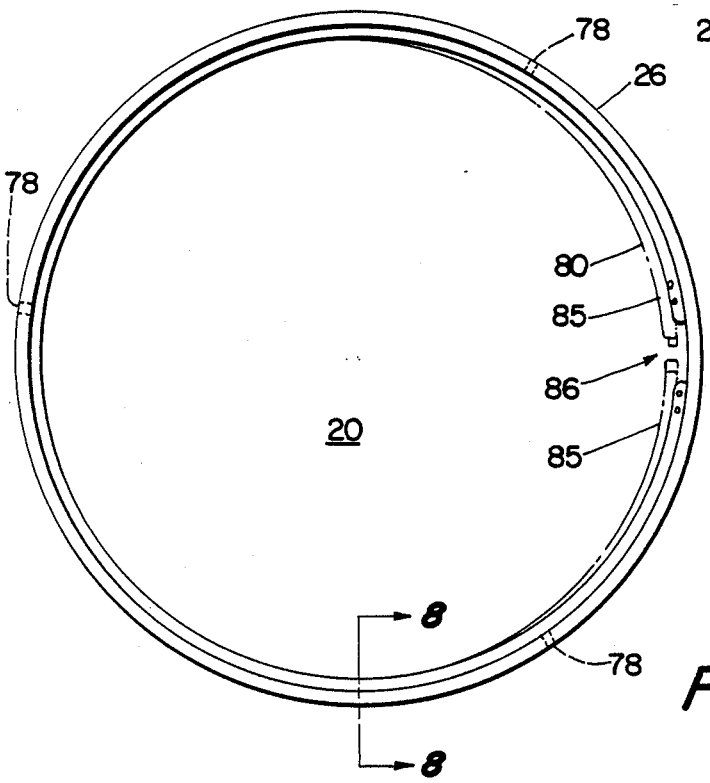
FIG. 7 is a horizontal view of the substrate support structure of the present invention.
Figure 8:
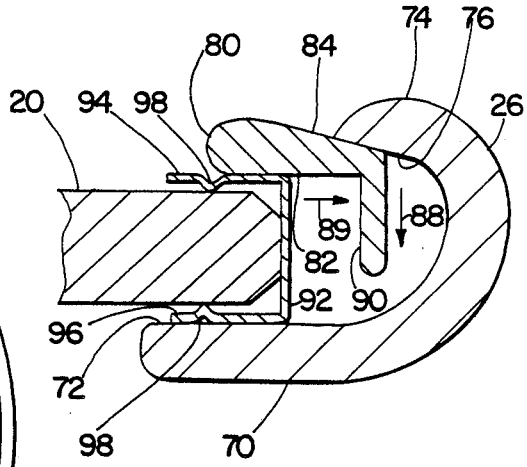
FIG. 8 is a vertical sectional view taken generally along lines 8—8 in FIG. 7.

With reference to FIGS. 7 and 8, the support ring 26 is described. The support ring 26 is a circular element made of anodized aluminum or other suitable material with a C-shaped cross section. The mouth of the "C" is directed inward toward the radial center of the circular element. The bottom leg of the "C" forms a first inwardly extending edge portion 70 about the inner periphery of the support ring, and a generally planar component support surface shown generally at 72. The component support surface 72 defines a circle having an inside diameter less than the diameter of the component it is to support.

The upper leg of the "C" forms a second inwardly extending edge portion 74 about the inner periphery of the support ring 26. The second edge portion 74 is axially displaced from the first edge portion 70, and forms a compression surface shown generally at 76 and defines a component access aperture having an inside diameter greater than the diameter of the component.

Referring to the figures, it can be seen that the outer edge of the support ring 26, or the back of the "C" is rounded to reduce high voltage gradients. At a plurality of circumferentially spaced locations on the ring 26, radially aligned holes 78 are provided to receive pins 34 and 48. It is to be noted that holes 78 are through holes so that pins 34 and 48 can extend through the support ring 26 and contact the perimetral edge of the component for radial positioning of the component in the support ring (described in more detail below).

With further reference to FIGS. 7 and 8, a retaining ring 80 is described. The retaining ring 80 is a generally flat split spring ring. One side of the retaining ring 80 forms a planar inner surface shown generally at 82, while the opposite side forms an outer edge surface shown generally at 84. An expansion/contraction gap, shown generally at 86, is also provided to allow for contraction and expansion of the ring 80. In its relaxed, expanded state, the outside diameter of the retaining ring 80 is larger than the access aperture of the support ring 26. It is however contractible to a diameter slightly less than the inside diameter of the access aperture so that the retaining ring can pass through the access aperture and upon expansion, engage the support ring compression surface. The contracted state of the retaining ring is shown in phantom in FIG. 7.

In the preferred embodiment, the retaining ring 80 has a wedge shaped cross-section. Outer edge surface 84 is bevelled or rounded, but other cross-sectional shapes could be employed.

In operation, a component assembly is placed in the support ring 26 by passing the component through the access aperture and seating the component onto the component support surface 72. The retaining ring 80 is contracted so that its outside diameter is less than the inside diameter of the access aperture, and is placed on top of the component so that the retaining ring inner surface 82 contacts the perimetral edge of the component on a side opposite the component support surface 72. As the retaining ring is allowed to expand, the retaining ring outer edge surface 84 engages the support ring compression surface 76. The interaction between the surfaces 84 and 76 creates an axial compression force (shown as arrow 88) between the retaining ring inner surface 82 and the component support surface 72 to compress the component between surfaces 82 and 72 as radial expansion of the retaining ring 80 occurs (shown as arrow 89). As the retaining ring expands outward (deeper in the support ring), it is forced to clamp the component more tightly. This interaction creates a substantially equal compression force about the circumference of the component except, of course, where the expansion/contraction gap 86 is positioned.

The retaining ring 80 is also configured with tooling holes 85, shown in FIG. 7, to aid in the contraction of the ring for insertion. Tooling, similar to commonly available snap-ring pliers, are used in conjunction with the tooling holes to contract the ring.

It is to be noted that the component is held in place by the torsional spring effect of the retaining ring 80. Since the retaining ring is circular and not straight, it cannot twist out of the support ring. It is the support rings resistance to "coning" that creates the axial compression force that holds the component in place.

The retaining ring 80 can be optionally configured to include a wing portion 90, which extends perpendicular to the retaining ring inner surface 82 along the outer perimeter of the retaining ring 80 in a direction opposite the retaining ring outer edge surface 84. The wing portion 90 can be used as an aid in the insertion/removal of the component from the support ring 26. In this embodiment, the retaining ring is first placed over the component and compressed until the wing portion 90 contacts the outer peripheral edge of the component. The wing portion 90 in conjunction with the force exerted to contract the retaining ring "grabs" the component so that it can be manipulated and inserted through the access aperture and seated on the support surface 72. Relaxation of the contracting force causes the ring to expand engaging the compression surface 76 with the outer edge surface 84, as before. The provision of the wing portion 90 permits the assembly of the support structure in fewer steps and aids in the radial alignment of the component in the support ring. Holes (not shown) in wing portion 90 provide clearance for pins 34 and 48.

In an alternate embodiment of the present invention, a sheet metal band 92 extending around the entire perimeter of the component is provided. The band 92 includes a pair of radially extending flanges or edge portions 94, 96 which are axially displaced from one another by an amount slightly greater than the component thickness. In this fashion, band 92 accommodates the peripheral edge of the component and is sandwiched between the component and the component support surface, and the component and the retaining ring inner surface. The flanges or edge portions 94, 96 form an intermediate layer between one side of the component and the component support surface, and the other side of the component and the retaining ring inner surface. Dimples 98 may be provided around flanges 94, 96 to enhance electrical contact of band 92 to substrate 20 by providing localized contact force sufficient to penetrate surface oxides which may be produced.

The band 92 serves three functions. First, it spreads electrical charge and serves as an electrical connector between the component and the high voltage connection. Second, it protects the edges of the component from damage during handling and while in the support ring. Lastly, it can be used to handle the component. Tooling, jigging and fixturing can use the band while diminishing the chance of damage to the evaporated coatings.

A component mounted in a support structure, i.e., a support structure assembly can be easily mounted and demounted from within the tube envelope 10. The spring loaded pins 34, 48 are compressed and the support structure assembly positioned such that each of the pins 34, 48 radially align with one of the plurality of recesses 78. When released, the internal spring pressure extends the pins through each of the recesses 78 to contact the circumferential edge of the component (or metal band 92, if used). By momentarily contracting the retaining ring, thereby releasing the compression force on the component, the spring force on the pins equalizes, thus radially aligning the component with respect to the tube envelope 10. It can therefore be seen that the axial positioning of the rod/pin assembly along the tube envelope 10 axially aligns the support structure assembly within the tube envelope, while the spring loaded pins cause radial alignment of the component within the component support structure. If fixed pins are used, then the component is prealigned in the support ring before mounting within the tube envelope.

The structure of the present invention eliminates dozens of parts over prior designs and many cleaning and coating processes. Performance is improved because the few parts used have very few edges, each of which is equally or less sharp than those used in previous designs. Because no special coatings, aside from anodizing, are required and no sharp edges such as from threaded fasteners exist, very few, if any, loose particles should exist. Additionally, there is more distance between the support ring and the walls of the tube envelope (between high negative potential and ground). The component support of the present invention also makes the tube more rugged. Since the components are supported more firmly over a greater area, movement relative to the support ring is substantially reduced rendering mechanical disturbances less detrimental. These factors all lead to a more stable tube that is less likely to have emission points.

While the preferred and alternate embodiments have been described with particular reference to panel type image intensifier tubes, it is to be appreciated that the present invention will find utility in any type of vacuum tube device where there is a sensitivity to loose particles.

The terms and expressions which have been employed here are used as terms of description and not of limitations, and there is no intention, in the use of such terms and expressions, of excluding equivalents of the features shown and described, or portions thereof, it being recognized that various modifications are possible within the scope of the invention claimed.

Having thus described the preferred embodiment, the invention is now claimed to be:

1. In a proximity type image intensifier tube having an evacuated, electrically conductive envelope, an input window, an output window, an output display screen on the output window, a high voltage photocathode carrying component mounted between the input window and output display screen, an improved structure for supporting the component within the tube envelope, said structure comprising a. a support ring comprising a first inwardly extending edge portion forming a component support surface having an inside diameter less than the component diameter, and a second inwardly extending edge portion axially displaced from the first edge portion, said second edge portion forming a component access aperture having an inside diameter greater than the component diameter and a compression surface; and b. a retaining ring comprising a split spring ring which is contractible to a diameter smaller than the inside diameter of the component access aperture and which is expandable to a diameter larger than the inside diameter of the component access aperture and including a planar inner surface and an outer edge surface, the outer edge surface engageable with the support ring compression surface so that expansion of the retaining ring compresses the component between the retaining ring inner surface and the component support surface.

2. The support structure of claim 1 additionally comprising a metal band extending around the perimeter of the component.

3. The support structure of claim 2 wherein the metal band is wrapped around the perimetral edge of the component and is sandwiched between the component and the component support surface, and the component and the retaining ring inner surface.

4. The support structure of claim 3 wherein the metal band additionally comprises a plurality of dimples.

5. The support structure of claim 1 wherein the retaining ring additionally comprises a wing portion extending perpendicular to the retaining ring inner surface along the outer perimeter of the retaining ring.

6. The support structure of claim 1 wherein the retaining ring has a generally wedge shaped cross-section and the support ring compression surface is bevelled so that radial expansion of the retaining ring creates an axial compression force between the retaining ring inner surface and the component support surface.

7. The support structure of claim 1 wherein the support ring has a rounded outer edge.

8. The support structure of claim 1 wherein the retaining ring additionally comprises tooling means for aiding the contraction of the spring ring.

9. The support structure of claim 1 additionally comprising a plurality of electrically insulated rods arranged in the plane of the component, each of the rods being connected at one end to the envelope and means for connecting the distal ends of the rods to the circumference of the support ring.

10. The support structure of claim 9 wherein the rods are oriented perpendicularly to the support ring circumference and wherein each of the distal rod ends comprise a protruding pin and the support ring has a plurality of recesses about its edge for receiving the rod pins.

11. The support structure of claim 9 further comprising a conductor positioned within one of the rods and extending along its length, the conductor being electrically connected to the component for supplying high voltage thereto relative to the tube envelope and the display screen.

12. The support structure of claim 10 wherein the rod pins extend through the support ring recesses and contact the perimetral edge of the component for radial positioning of the component in the support ring.

13. The support structure of claim 12 wherein at least one of the rod pins is spring loaded against the perimetral edge of the component.

14. In a vacuum tube having an evacuated envelope, an improved structure for supporting a component within the tube envelope, said structure comprising:

a. a support ring having a generally C-shaped cross-section comprising a first inwardly extending edge portion forming a surface for supporting the component about the component perimeter and a second inwardly extending edge portion axially displaced from the first edge portion and forming a component access aperture and a compression surface; and b. a retaining ring comprising a generally flat split spring ring having a planar inner surface and an outer edge surface, said spring ring radially contractible to a diameter less than the component access aperture, and radially expandable to a diameter greater than the access aperture, the outer edge surface engageable with the support ring compression surface so that radial expansion of the retaining ring axially compresses the component perimeter between the retaining ring inner surface and the support ring component support surface.

15. The support structure of claim 14 further comprising a metal band comprising a pair of radially extending edge portions axially displaced from one another and extending around the perimetral edge of the component.

16. The support structure of claim 15 wherein the edge portions of said metal band comprise a plurality of dimples.

17. The support structure of claim 14 wherein the axial compression of the component is substantially equal about the component perimeter except in the area of the spring ring split.

18. The support structure of claim 14 wherein the retaining ring has a generally wedge shaped cross-section and the support ring compression surface is bevelled so that radial expansion of the retaining ring creates an axial compression force between the retaining ring inner surface and the component support surface.

19. The support structure of claim 14 wherein the support ring has a rounded outer edge.

20. The support structure of claim 14 wherein the retaining ring additionally comprises tooling means for aiding the contraction of the spring ring.

21. A radiation sensitive image intensifier tube comprising:

a. an evacuated tube envelope;

b. an input window;

c. an output window;

d. an output display screen on the output window;

e. a high voltage component mounted axially between the input window and the output display screen;

f. support means for supporting the component within the tube envelope, said support means comprising;

i. a support ring comprising a first inner peripheral edge portion forming a generally planar surface for supporting the component about the component perimeter; and a second inner peripheral edge portion axially displaced from the first inner peripheral edge portion and forming a component access aperture and a compression surface; and ii. a retaining ring comprising a generally flat split spring ring having a substantially planar inner surface and an outer peripheral edge surface, said spring ring radially contractible to a diameter less than the component access aperture and radially expandable to a diameter greater than the component access aperture, the outer peripheral edge surface of the spring ring interfaceable with the compression surface of the support ring so that radial expansion of the spring ring axially compresses the component perimeter between the retaining ring inner surface and the support ring support surface.

22. The support means of claim 21 further comprising a metal band extending about the perimeter of the component and including a pair of radially extending flange portions axially displaced from one another for accommodating the peripheral edge of the component between the flange portions and forming an intermediate layer between one side of the component and the support ring support surface, and the other side of the component and the retaining ring inner surface.

23. The support means of claim 21 wherein the support ring has a rounded outer edge.

24. The support means of claim 21 wherein the retaining ring additionally comprises tooling means for aiding the contraction of the spring ring.

* * * * *